US012258669B2

(12) United States Patent
Mol et al.

(10) Patent No.: US 12,258,669 B2
(45) Date of Patent: Mar. 25, 2025

(54) PROCESS AND SYSTEM FOR THE ELECTROCHEMICAL REDUCTION OF OXALIC ACID

(71) Applicant: Avantium Knowledge Centre B.V., Amsterdam (NL)

(72) Inventors: Arnaud Mol, Amsterdam (NL); Faezeh Esmaeili, Amsterdam (NL); Matthew Philips, Amsterdam (NL); Mariana Paredinha Araujo, Amsterdam (NL)

(73) Assignee: Avantium Knowledge Centre B.V., Amsterdam (NL)

( * ) Notice: Subject to any disclaimer, the term of this patent is extended or adjusted under 35 U.S.C. 154(b) by 0 days.

(21) Appl. No.: 18/037,435

(22) PCT Filed: Nov. 25, 2021

(86) PCT No.: PCT/EP2021/082909
§ 371 (c)(1),
(2) Date: May 17, 2023

(87) PCT Pub. No.: WO2022/112375
PCT Pub. Date: Jun. 2, 2022

(65) Prior Publication Data

US 2023/0416930 A1 Dec. 28, 2023

(30) Foreign Application Priority Data

Nov. 26, 2020 (EP) ..... 20210026

(51) Int. Cl.
*C25B 3/25* (2021.01)
*C25B 3/07* (2021.01)
(Continued)

(52) U.S. Cl.
CPC ..... *C25B 3/07* (2021.01); *C25B 3/25* (2021.01); *C25B 9/13* (2021.01); *C25B 15/023* (2021.01); *C25B 15/087* (2021.01)

(58) Field of Classification Search
CPC .... C25B 3/25; C25B 9/13; C25B 9/19; C25B 15/05; C25B 15/029; C25B 15/08; C25B 15/087; C25B 15/02
(Continued)

(56) References Cited

U.S. PATENT DOCUMENTS 3,779,875 A 12/1973 Michelet
3,779,876 A * 12/1973 Michelet ..... C25B 3/25 205/443
(Continued)

FOREIGN PATENT DOCUMENTS

CN 1281063 A * 1/2001 ..... C25B 3/25
CN 1322860 A * 11/2001 ..... C25B 3/25
JP S5565373 A 5/1980

OTHER PUBLICATIONS

Chen et al., "A New Method of Ion Chromatography Technology for Speedy Determination and Analysis in Organic Electrosynthesis of Glyoxylic Acid," Journal of Chromatography A (Sep. 30, 2005), vol. 1089, Nos. 1-2, pp. 142-147. (Year: 2005).*
(Continued)

*Primary Examiner* — Edna Wong
(74) *Attorney, Agent, or Firm* — Suiter Swantz IP

(57) ABSTRACT

The present disclosure concerns a process and a system for the electrochemical reduction of oxalic acid to glyoxylic acid. The process involves withdrawing a portion of oxalic acid-depleted catholyte from the process and contacting it with a quantity of solid oxalic acid to provide a concentrated oxalic acid solution which is re-entered into the process.

10 Claims, 5 Drawing Sheets

(51) Int. Cl.

| | |
|---|---|
| ***C25B 9/13*** | (2021.01) |
| ***C25B 9/19*** | (2021.01) |
| ***C25B 15/02*** | (2021.01) |
| ***C25B 15/023*** | (2021.01) |
| ***C25B 15/029*** | (2021.01) |
| ***C25B 15/08*** | (2006.01) |

(58) Field of Classification Search
USPC ..... 205/443
See application file for complete search history.

(56) References Cited

U.S. PATENT DOCUMENTS 4,692,226 A 9/1987 Gimenez et al.
5,395,488 A 3/1995 Scharbert et al.
2013/0105304 A1* 5/2013 Kaczur ..... C25B 9/23 204/290.01
2019/0264340 A1* 8/2019 Mitsushima ..... C25B 15/08

OTHER PUBLICATIONS

Nour et al., "HPLC Organic Acid Analysis in Different Citrus Juices Under Reversed Phase Conditions," Notulae Botanicae Horti Agrobotanici Cluj-Napoca (Jun. 15, 2010), vol. 38, No. 1, pp. 44-48. (Year: 2010).*
International Search Report and Written Opinion for PCT/EP2021/082909, mailed Mar. 4, 2022.
F. Goodridge, et al. "Scale-up studies of the electrolytic reduction of oxalic to glyoxylic acid" Journal of Applied Electrochemistry 10 (1980) pp. 55-60.
J.R. Ochoa, et al. "Electrosynthesis of glyoxylic acid using a continuously electrogenerated lead cathode" Journal of Applied Electrochemistry 23 (1993), pp. 905-909.

* cited by examiner

PROCESS AND SYSTEM FOR THE ELECTROCHEMICAL REDUCTION OF OXALIC ACID

FIELD

The present invention is in the field of electrochemistry, especially in the field of electrochemical conversion of oxalic acid (OA) to glyoxylic acid (GA).

BACKGROUND ART

Glyoxylic acid is an important reagent in the preparation of industrially relevant compounds, including pharmaceuticals such as β-lactam antibiotics (methicillin, oxacillin, and nafcillin) and allantoin, as well as vanillin which is perfume and food products.

Glyoxylic acid (COOHCHO) can be prepared either by controlled oxidation of glyoxal or by electrochemical reduction of oxalic acid (COOHCOOH). The electrochemical (electrolytic) reduction of oxalic acid to give glyoxylic acid has been known for more than 100 years and is generally carried out in an aqueous, acidic medium, at low temperature, on electrodes having a high hydrogen overpotential, such as lead-based electrodes. In order to avoid electrooxidation of both oxalic acid and glyoxylic acid, the process is typically carried out in a divided cell using ion exchange membrane and as catholyte a solution of oxalic acid (see e.g., F. Goodridge et al., Journal of Applied Electrochemistry 10 (1980) pp. 55-60; J. R. Ochoa et al., Journal of Applied Electrochemistry 23 (1993) 905-909).

The main reaction on the cathode surface is $$COOHCOOH+2H^{+}2e^{-}\rightarrow COOHCHO+H_2O$$

The main reaction on the anode surface is $$2H_2O\rightarrow O_2+4H^{+}+4e^{-}$$

Since oxalic acid is consumed in the reaction at the cathode surface oxalic acid needs to be replenished, which is generally done by adding portions of solid oxalic acid (e.g. granules) or of a solution of oxalic acid either in the course of the reaction or before entering a next stage in the reaction. See e.g. CN1281063, U.S. Pat. Nos. 3,779,875 and 469,226. In for example U.S. Pat. No. 3,779,875 also a process is described in which a solution with a fixed concentration of oxalic acid is continuously supplied to the electrochemical cell, while at the same time continuously removing the catholyte to keep the volume constant. In the processes of CN1281063 and U.S. Pat. No. 3,779,875 and an amine/ammonium adjuvant is required to promote the reaction.

Glyoxylic acid product streams, produced according to processes known in the art, are reported to only contain up to about 10 wt % of glyoxylic acid. Water removal is needed in order to reach higher product concentrations, requiring energy intensive processes, like boiling off the water and/or pumping it off.

To separate the glyoxylic acid product, the product stream is generally subjected to evaporation under vacuum, accompanied by crystallization and filtration of the oxalic acid, followed by a second concentration stage to either the commercial specification of a 50 wt % aqueous solution or to solid glyoxylic acid.

The electroreduction reaction is typically run at 10-15° C. in order to prevent excessive hydrogen ($H_2$) formation and to prevent the undesired formation of glycolic acid ($HOCH_2COOH$). However, at this temperature the solubility of oxalic acid is reduced to only 0.6-0.8 M. In order to prevent precipitation of oxalic acid, additional water is introduced in the catholyte holding tank. However, this results in undesirable dilution of the glyoxylic acid product stream, making product separation more labour- and capital-intensive.

It is an object of the present invention to provide an energy efficient oxalic acid electroreduction process that results in a concentration of glyoxylic acid in the electrochemical reduction product stream higher than the 10% of the prior art processes, as this will benefit the downstream separation steps, resulting in industrially relevant higher glyoxylic acid yields.

SUMMARY OF THE INVENTION

This objective is attained by a process for the electrochemical reduction of oxalic acid to glyoxylic acid, wherein the process is performed in an electrochemical cell comprising a cathode compartment containing a cathode, an anode compartment containing an anode and an ion exchange membrane separating the anode compartment from the cathode compartment, wherein the process comprises the steps of:

(a) feeding an anolyte comprising an acid to the anode compartment;

(b) feeding a liquid catholyte comprising an aqueous oxalic acid solution to the cathode compartment, wherein the liquid catholyte is moving in a catholyte loop by being passed from a catholyte holding tank into the cathode compartment, over the surface of the cathode, being removed from the cathode compartment as an oxalic acid-depleted catholyte and returned to the catholyte holding tank;

(c) applying an electric potential difference between the cathode and the anode sufficient to produce a glyoxylic acid recoverable from the cathode compartment, wherein during the process one or more quantities of concentrated oxalic acid solution are provided to the liquid catholyte by the steps of (d) withdrawing a portion of the oxalic acid-depleted catholyte from the catholyte loop and/or from the catholyte holding tank and contacting it with a quantity of solid oxalic acid to provide a concentrated oxalic acid solution (e) feeding at least a portion of the concentrated oxalic acid solution to the catholyte holding tank.

Herein, in an electrochemical reduction process of oxalic acid (OA) to glyoxylic acid (GA), additional oxalic acid is supplied to the process in concentrated form. More specifically, by moving the catholyte in a catholyte loop and employing a side stream of this catholyte loop or the holding tank for dissolving solid oxalic acid, a concentrated oxalic acid stream is obtained which is resupplied to the catholyte loop for passing over the cathode. Advantageously, additional oxalic acid is provided in a controlled way, optionally in a multiple of instances, during the electrochemical reduction process, such that the oxalic acid concentration in the catholyte is kept between pre-defined limits or even constant throughout the process. The process according to the invention results in an increased concentration of glyoxylic acid in the product stream, which obviates the necessity of complicated, time-consuming and expensive evaporation and separation steps.

In another aspect there is disclosed a system for carrying out the process as described herein, said system comprising an electrochemical cell comprising a cathode compartment containing a cathode, an anode compartment containing an anode and an ion exchange membrane separating the anode compartment from the cathode compartment a catholyte loop fluidly connecting the cathode compartment and a catholyte holding tank, said catholyte loop being configured for moving a liquid catholyte from the catholyte holding tank into the cathode compartment, over the surface of the cathode, and removing from the cathode compartment and returning to the catholyte holding tank an oxalic acid-depleted catholyte an energy source configured for applying an electric potential difference between the cathode and the anode and to reduce oxalic acid in the cathode compartment to glyoxylic acid, means for withdrawing a portion of an oxalic acid-depleted catholyte from the catholyte loop and/or from the catholyte holding tank means for contacting the oxalic acid-depleted catholyte portion with a quantity of solid oxalic acid to provide a concentrated oxalic acid solution, and means for providing at least a portion of the concentrated oxalic acid solution to the catholyte holding tank.

BRIEF DESCRIPTION OF THE DRAWINGS

Further details, aspects, and embodiments will be described, by way of example only, with reference to the drawings. Elements in the figures are illustrated for simplicity and clarity and have not necessarily been drawn to scale. In the figures, elements which correspond to elements already described may have the same reference numerals. In the drawings, FIG. 1 schematically shows a reaction system for the electrochemical reduction of oxalic acid to glyoxylic acid according to the present disclosure FIG. 2 schematically shows a reaction system for the electrochemical reduction of oxalic acid to glyoxylic acid according to the present disclosure

DETAILED DESCRIPTION OF EMBODIMENTS

Figure 1:
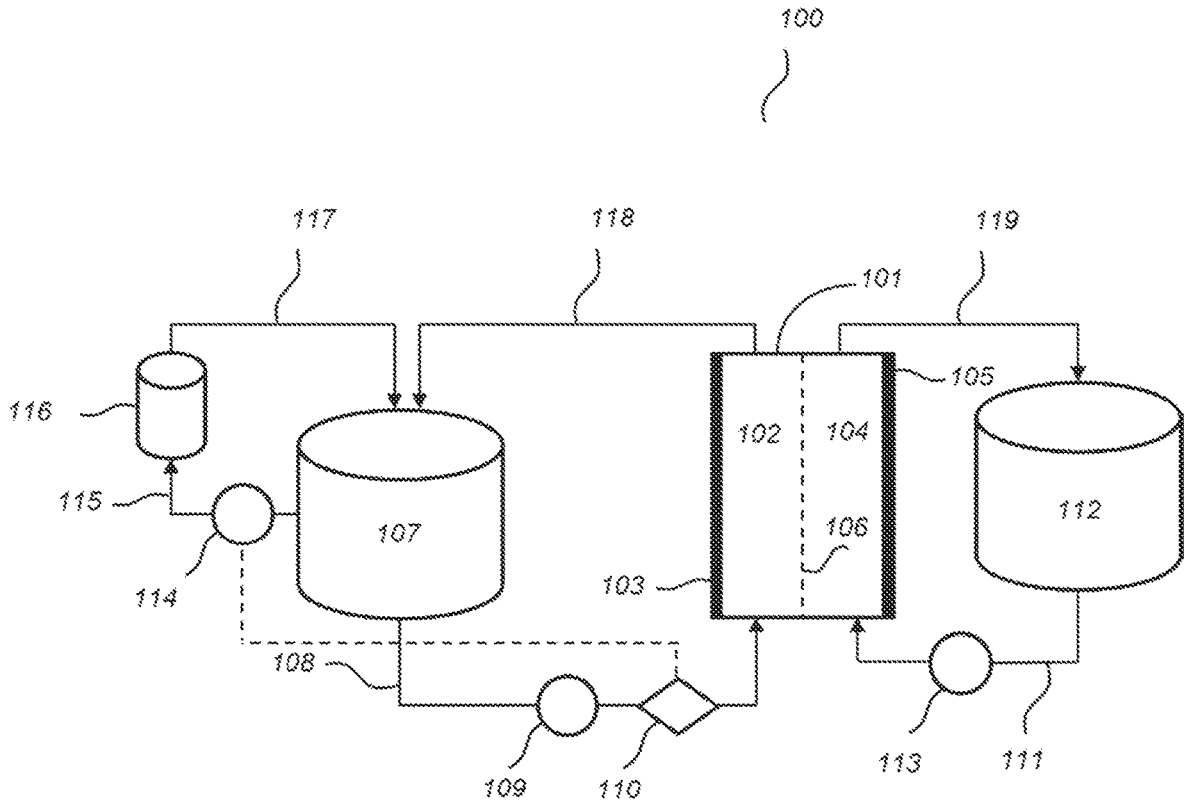

The inventors developed an electrochemical process and a reaction system for the conversion of oxalic acid to glyoxylic acid. The process according to the invention affords glyoxylic acid in high concentrations in the product stream and in high yields. The overall water balance is carefully managed according to the process of the invention. As such, the process of the invention is an industrially more efficient process, and requires fewer and/or less intensive downstream separation steps.

In the process according to the invention, oxalic acid is reduced into glyoxylic acid at the cathode. The process according to the invention is performed in an electrochemical cell comprising a cathode compartment containing a cathode, an anode compartment containing an anode and an ion-exchange membrane separating the anode compartment from the cathode compartment. The process comprises (a) feeding an anolyte comprising an acid to the anode compartment;

(b) feeding a liquid catholyte comprising an aqueous oxalic acid solution to the cathode compartment, wherein the liquid catholyte is moving in a closed catholyte loop by being passed from a catholyte holding tank into the cathode compartment, over the surface of the cathode, being removed from the cathode compartment as an oxalic acid-depleted catholyte and returned to the catholyte holding tank;

(c) applying an electric potential difference between the cathode and the anode sufficient to produce a glyoxylic acid recoverable from the cathode compartment, and wherein during the process one or more quantities of concentrated oxalic acid solution are provided to the liquid catholyte by the steps of (d) withdrawing a portion of the oxalic acid-depleted catholyte from the catholyte loop and/or from the catholyte holding tank and contacting it with a quantity of solid oxalic acid to provide a concentrated oxalic acid solution (e) feeding at least a portion of the concentrated oxalic acid solution to the catholyte holding tank.

Steps (a)-(c) involve the regular operation of an electrochemical cell. In order to properly operate the electrochemical these steps are typically performed simultaneously.

In the following, for the sake of understanding, elements of embodiments are described in operation. However, it will be apparent that the respective elements are arranged to perform the functions being described as performed by them. Further, the subject matter that is presently disclosed is not limited to the embodiments only, but also includes every other combination of features described herein or recited in mutually different dependent claims.

Electrochemical cells are well-known in the art, and generally comprise an anode and a cathode separated by one or more semi-permeable membranes located in between the anode and cathode, as such forming an anode compartment and a cathode compartment. In operation, an oxidation reaction occurs at the anode and a reduction reaction occurs at the cathode. The electrolytic reduction may be carried out continuously, preferably wherein a plurality of electrochemical cells are connected in parallel.

The electrochemical cell wherein the process according to the present disclosure is performed, contains a cathode compartment and an anode compartment which are separated by an ion exchange membrane. Preferably, the ion exchange membrane is a cation exchange membrane comprising a polymer-based material having carboxyl and/or sulfonic acid groups. In one embodiment, the ion exchange membrane is based on sulfonated tetrafluoroethylene-based fluoropolymer-copolymer. This type of membranes is known under the trade name Nafion® (Chemours) with various specific cationic conductivities. A preferred ion exchange membrane is Nafion® N324 which based on perfluorosulfonic with a polytetrafluoroethylene fiber reinforcement.

The cathode can be any cathode known in the art to be suitable for the reduction of oxalic acid into glyoxylic acid. Such cathodes are known to the skilled person, e.g. from F. Goodridge et al., Journal of Applied Electrochemistry 10 (1980) pp. 55-60; J. R. Ochoa et al., Journal of Applied Electrochemistry 23 (1993) 905-909; and U.S. Pat. No.

5,395,488A. Such cathodes may be referred to as catalytic cathodes, and typically contain cadmium, lead, solid amalgams of lead, or alloys of lead with e.g. silver, antimony, tin or bismuth. The cathode is typically made from one type of material, e.g. a lead plate, but may also contain different materials in the interior and on the surface, such as a lead plate with a lead alloy surface. The cathode may be structured as a sheet, mesh, perforated plate, rod, or wire. In a preferred embodiment, the cathode comprises a lead sheet.

Possible anode materials are all those materials which sustain the anode reactions. Examples of such materials are metals and metalloids such as platinum, platinised titanium, graphite, lead and its alloys, particularly with silver, antimony, thallium or tin. Another suitable type of suitable anode material is titanium (Ti) coated with mixed-metal oxides (MMO). In one embodiment, the anode material is a so-called dimensionally stable anode (DSA®), which comprises titanium coated with a mixed metal oxide composition comprising elements such as iridium, ruthenium, platinum, rhodium, or tantalum. A preferred anode material is iridium oxide coated titanium (IrOx/Ti). The anode may be structured as a sheet, mesh, perforated plate, rod, or wire.

The electrochemical cell contains an inlet for receiving anolyte to the anode compartment and an inlet for receiving catholyte to the cathode compartment, and outlets for discharging reaction products and for providing one or more loops for recirculation of the catholyte and anolyte. Such catholyte and anolyte loops fluidly connect the electrochemical cell with catholyte and anolyte holding vessels, respectively, which are used for providing and replenishing the respective compositions.

As an anolyte, any liquid capable of enabling electrical conductivity between the electrodes can be used. Preferred anolyte liquids are aqueous solutions of strong acids or mineral acids such as sulfuric acid, phosphoric acid, and hydrochloric acid. Generally, such aqueous acid solutions are used in a concentration of 0.5-2 mol/litre, and preferably 0.8-1.2 mol/litre.

The catholyte comprises an aqueous solution of oxalic acid, which functions as both reactant and electrolyte. Optionally, the catholyte may comprise additional components such as strong acids or mineral acids such as sulphuric acid, phosphoric acid and hydrochloric acid. The catholyte may further comprise small amounts of reaction by-products such as glycolic acid or glyoxal.

Since the oxalic acid is reactant as well as electrolyte, and therefore should not deplete, according to the process of the invention the oxalic acid concentration is kept essentially constant, i.e. only small variations are allowed, by measuring and controlling the conductivity of the solution (i.e. the concentration of oxalic acid). Also too high concentrations of oxalic acid are unfavourable and should be avoided, as that would cause it to drop out of the solution and would lower the solubility of glyoxylic acid.

The flow of the catholyte in the catholyte loop is typically achieved by means of one or more recirculation pumps in the loop fluidly connecting the cathode compartment and the catholyte holding tank. The catholyte loop may additionally be fluidly connected to one or more supporting devices such as one or more heat exchangers and/or expansion vessels. The one or more heat exchangers allow control of the reaction temperature; the one or more expansion vessels allow the extraction of glyoxylic acid reaction product, the withdrawal of oxalic-acid depleted catholyte and the addition of concentrated oxalic acid.

In an embodiment, the anolyte is also circulated, so that the pressure on either side of the separating membrane can be substantially the same.

An electric potential difference is applied between the anode and the cathode of the electrochemical cell. According to the process of the present disclose, the anode is positively charged and the cathode negatively charged. Thus, an electrical potential is applied to either electrode of the electrochemical cell such that the anode is at a higher potential than the cathode. The electrical potential may be a DC voltage. In preferred embodiments, the applied electrical potential is generally between about 2 V and about 10 V, preferably from about 3 V to about 9V, such as in the range of 3 V to 8V and more preferably from about 3.0V to about 7.0V.

It is noted that applying an electrical potential difference is considered synonymous with creating a voltage between the cathode and the anode, so that the anode is at a higher potential than the cathode. The process may be controlled by setting a certain voltage (galvanostatic) or by setting a certain current (potentiostatic). If the voltage is set, the current will automatically follow from the reactions that occur in the cell. If the current is set, the voltage will automatically follow from the reactions that occur in the cell. The process according to the invention is equally workable in both operation modes. Typically, the current is controlled in the start-up phase of an electrochemical cell, in order to find the optimal voltage for the desired reaction, while during standard operation of the electrochemical cell, the voltage will be controlled. The process according to the invention operates with such a voltage difference and/or such a current that oxalic acid is reduced at the cathode to mainly form glyoxylic acid.

Preferably, the current density of the electrochemical cell during operation is at least 10 $mA/cm^2$, such as in the range of 10 $mA/cm^2$ and 600 $mA/cm^2$, more preferably at least 100 $mA/cm^2$, such as in the range 100 $mA/cm^2$-500 $A/cm^2$. A certain minimal current, typically at least 100 $mA/cm^2$, preferably at least 400 $mA/cm^2$, is preferred in terms of process economics, as below these values too little product is formed for an economically viable process. The upper limit of the current at which the process can operate is solely determined by safety issues. For example, it the current is too high, the cell may heat up too much. Other than that, higher currents are preferred since it will result in more product formation. Excellent results have been obtained with a current density in the range of 50-300 $mA/cm^2$. Herein, the currents are defined based on the projected area of the electrode. The optimal current for the process according to the invention may differ based on the exact conditions that are applicable in the electrochemical cell, and the skilled person is able to determine the optimal current in terms of product conversions.

During the electrochemical reduction process, oxalic acid is reduced in the cathode compartment to glyoxylic acid. A cathodic product stream may be removed intermittently or continuously by withdrawing a portion from the catholyte loop downstream of the cathode compartment and providing this product stream to a work-up section for further processing as described below.

Glyoxylic acid produced by the electroreduction process is isolated by means known to the person skilled in the art, especially by concentrating, optionally under reduced pressure, of the cathodic product stream and removal of oxalic acid. In one embodiment, the product stream is subjected to evaporation at elevated temperature under vacuum, accompanied by precipitation at reduced temperature and filtration of the oxalic acid. In another embodiment, the oxalic acid is fixed selectively onion exchanger resins. These steps may be followed by a second concentration stage to yield either the commercial specification of a 50 wt % aqueous solution or to solid crystalline glyoxylic acid. The degree of concentration of glyoxylic acid and the cooling temperature naturally vary according to the degree of purity desired for the glyoxylic acid and according to the state in which it is desired (e.g., solution or crystals). In an embodiment, concentration of the product stream is accomplished by evaporation under vacuum at a temperature in the range of 25-60° C., preferably 30-40° C. In an embodiment, precipitation of oxalic is accomplished by cooling to a temperature in the range of 0° C. to 10° C., preferably 0° C. to 8° C., more preferably 3° C. to 5° C. In an embodiment, at least a fraction of the solid oxalic acid thus obtained is used for providing the concentrated oxalic acid stream of the present disclosure.

The electrochemical conversion of oxalic to glyoxylic acid results in a reduction of the oxalic acid concentration in the cathode compartment, thus producing an oxalic acid-depleted catholyte stream leaving the cathode compartment. In the process according to the present disclosure, a portion of the oxalic acid-depleted catholyte is withdrawn from the catholyte loop and/or from the catholyte holding tank. In an embodiment, the oxalic acid-depleted catholyte is withdrawn from the catholyte holding tank. In an embodiment, the oxalic acid-depleted catholyte is withdrawn from the catholyte loop. Preferably, the oxalic acid-depleted catholyte is withdrawn from the catholyte loop downstream of the cathode department outlet and upstream of the catholyte holding tank. In an embodiment, oxalic acid-depleted catholyte is withdrawn at regular intervals from the catholyte loop and/or the catholyte holding tank.

In one embodiment, the timing of the withdrawal of oxalic acid-depleted catholyte is controlled by measuring the concentration of oxalic acid in the catholyte loop. This may be done by measuring the conductivity of the solution in the catholyte loop, which is a measure for the concentration of oxalic acid. The concentration of oxalic acid in the catholyte loop may be determined intermittently or continuously. In one embodiment, the concentration of oxalic acid in the catholyte loop is measured upstream of the catholyte inlet of the cathode compartment, for example by a device or an apparatus fluidly connected to the catholyte loop and configured for determining a parameter of the catholyte loop that is as measure for the concentration of oxalic acid in that part of the catholyte loop. In one embodiment, the concentration of oxalic acid in the catholyte loop is measured directly by in-line analytical means, such as high-performance liquid chromatography (HPLC). In a preferred embodiment, the concentration of oxalic acid in the catholyte loop is measured continuously, preferably by using HPLC.

The device or apparatus configured for indirectly or directly determining the concentration of oxalic acid in the catholyte loop may be connected to a pump configured for withdrawing a portion of oxalic acid-depleted catholyte stream from the catholyte loop. For example, if the device or apparatus configured for determining the concentration of oxalic acid in the catholyte loop has found an oxalic acid concentration that falls below a pre-defined lower limit, a signal may be sent from said device or apparatus to the pump to withdraw a defined quantity of oxalic acid-depleted catholyte from the catholyte loop or from the catholyte holding tank, with the purpose of using at least a portion of said oxalic acid-depleted catholyte withdrawn from the catholyte for preparing a concentrated oxalic acid solution for dosing into the catholyte holding tank.

In the process according to the present disclosure, the portion of oxalic acid-depleted catholyte withdrawn from the catholyte loop or the catholyte holding tank is contacted with a quantity of solid oxalic acid to provide a concentrated oxalic acid solution. In one embodiment, the portion of oxalic acid-depleted catholyte is passed through a column comprising solid oxalic acid. By using a column packed with solid oxalic acid allows and carefully selecting the column diameter and flow rate the speed of concentrating the catholyte with oxalic can be controlled, while turbulence which may cause solid oxalic to travel through the system and produce blockages is prevented. Columns, column materials, tanks and vessels can be used as generally known from chemical engineering handbooks. The exact set-up and size depend on the specific conditions such as volume to be handled. The column may be stirred to improve mass transfer in the column. A plurality of columns may be used in parallel either individually or simultaneously. The concentration of the concentrated oxalic acid solution resulting from contacting oxalic acid-depleted catholyte with solid oxalic acid is typically in the range of 0.1 to 12 mol/litre, preferably in the range of 0.3 to 10.0 mol/litre.

Advantageously, the one or more quantities of concentrated oxalic acid solution are provided to the liquid catholyte if the concentration of oxalic acid in the liquid catholyte fed to the cathode compartment falls below a predetermined level. In this way, the concentration of oxalic acid in the liquid catholyte is can be kept between predefined limits or even be kept substantially constant. In one embodiment, the concentration of oxalic acid in the catholyte holding tank is maintained in the range of 0.05 to 10 M, preferably in the range of 0.4-1 M, more preferably in the range of 0.6-1 M. The concentration ratio of glyoxylic acid to oxalic acid in the cathode compartment may be maintained in the range of 0.2:1 to 12:1, preferably in the range of 1:1 to 12:1, more preferably in the range of 3:1 to 12:1.

In another aspect of the present disclosure there is provided a system for carrying out the process as described herein, said system comprising

- an electrochemical cell comprising a cathode compartment containing a cathode, an anode compartment containing an anode and an ion exchange membrane separating the anode compartment from the cathode compartment
- a catholyte loop fluidly connecting the cathode compartment and a catholyte holding tank, said catholyte loop being configured for moving a liquid catholyte from the catholyte holding tank into the cathode compartment, over the surface of the cathode, and removing from the cathode compartment and returning to the catholyte holding tank an oxalic acid-depleted catholyte
- an energy source configured for applying an electric potential difference between the cathode and the anode and to reduce oxalic acid in the cathode compartment to glyoxylic acid,
- means for withdrawing a portion of an oxalic acid-depleted catholyte from the catholyte loop and/or from the catholyte holding tank
- means for contacting the oxalic acid-depleted catholyte portion with a quantity of solid oxalic acid to provide a concentrated oxalic acid solution, and
- means for providing at least a portion of the concentrated oxalic acid solution to the catholyte holding tank.

By monitoring the concentration of oxalic acid in catholyte loop and supplying a concentrated oxalic acid stream prepared from an oxalic acid-depleted stream withdrawn upstream in the system and dissolved solid oxalic acid, the glyoxylic acid product concentration can be much increased. For example, when the oxalic acid concentration is kept substantially constant at 0.6M a yield of glyoxylic acid in the product stream of at least 15 wt %, preferably at least 16 wt %, based on total weight of the product stream recoverable from the cathode compartment, may be obtained.

In one embodiment, the means for contacting the oxalic acid-depleted catholyte portion with a quantity of solid oxalic acid comprises one or more columns comprising solid oxalic acid.

In one embodiment, a plurality of columns is used in parallel either individually or simultaneously. In one embodiment, the one or more columns are stirred in order to improve mass transfer in the column.

In one embodiment, the system comprises means for intermittently or continuously determining the concentration of oxalic acid in the catholyte loop. Preferably, the system comprises means for continuously determining the concentration of oxalic acid in the catholyte loop. Preferably, the system is connected to a high-performance liquid chromatography (HPLC) apparatus for determining the concentration of oxalic acid in the catholyte loop.

In one embodiment, the system comprises an outlet port located in the catholyte loop upstream of the catholyte holding tank configured for withdrawing a portion of an oxalic acid-depleted catholyte from the catholyte loop.

In one embodiment, the system comprises an outlet port located at the catholyte holding tank configured for withdrawing a portion of an oxalic acid-depleted catholyte from the catholyte loop.

In the following, for the sake of understanding, elements of embodiments are described in operation. However, it will be apparent that the respective elements are arranged to perform the functions being described as performed by them. Further, the subject matter that is presently disclosed is not limited to the embodiments only, but also includes every other combination of features described herein or recited in mutually different dependent claims.

Referring to FIG. 1, a schematic illustrating a system 100 for the conversion of oxalic acid to glyoxylic acid according to an embodiment of the present disclosure is shown. System 100 may include an electrochemical cell 101 comprising a cathode compartment 102 comprising a cathode 103, and an anode compartment 104 comprising an anode 105, separated by an ion-exchange membrane 106. During operation, a liquid catholyte stream 108 comprising an aqueous oxalic acid solution is provided from a catholyte holding tank 107 by operation of a first pump 109 to cathode compartment 102. In cathode compartment 102, the oxalic acid containing catholyte is passed over cathode 103. By applying a suitable electric potential difference between the cathode 103 and the anode 105 using an external power source (not shown), glyoxylic acid is produced which is recoverable from the cathode compartment 102. An oxalic acid-depleted catholyte stream 118 is withdrawn from the cathode compartment 102 and returned to the catholyte holding tank 107. During operation, furthermore an acid-containing anolyte 111 may be fed from an anolyte holding tank 112 to the anode compartment 104 by operation of a second pump 113. In anode compartment 104, the anolyte is passed over anode 105. The anolyte stream 119 leaving the anode compartment 104 is returned to anolyte holding tank 112.

During operation, the concentration of oxalic acid and glyoxylic acid may be monitored by a suitable apparatus 110 arranged for indirectly or directly measuring concentrations of constituents of catholyte stream 108, for example by means of conductivity or chromatography (such as HPLC). Apparatus 110 is connected to a third pump 114 which is configured for withdrawing an oxalic acid-depleted liquid catholyte stream portion 115 from catholyte holding tank 107 and providing it to solid oxalic acid vessel 116. In solid oxalic acid vessel 116, liquid catholyte stream 115 is contacted with solid oxalic acid to provide a concentrated oxalic acid solution 117 which may be provided to catholyte holding tank 107.

Figure 2:
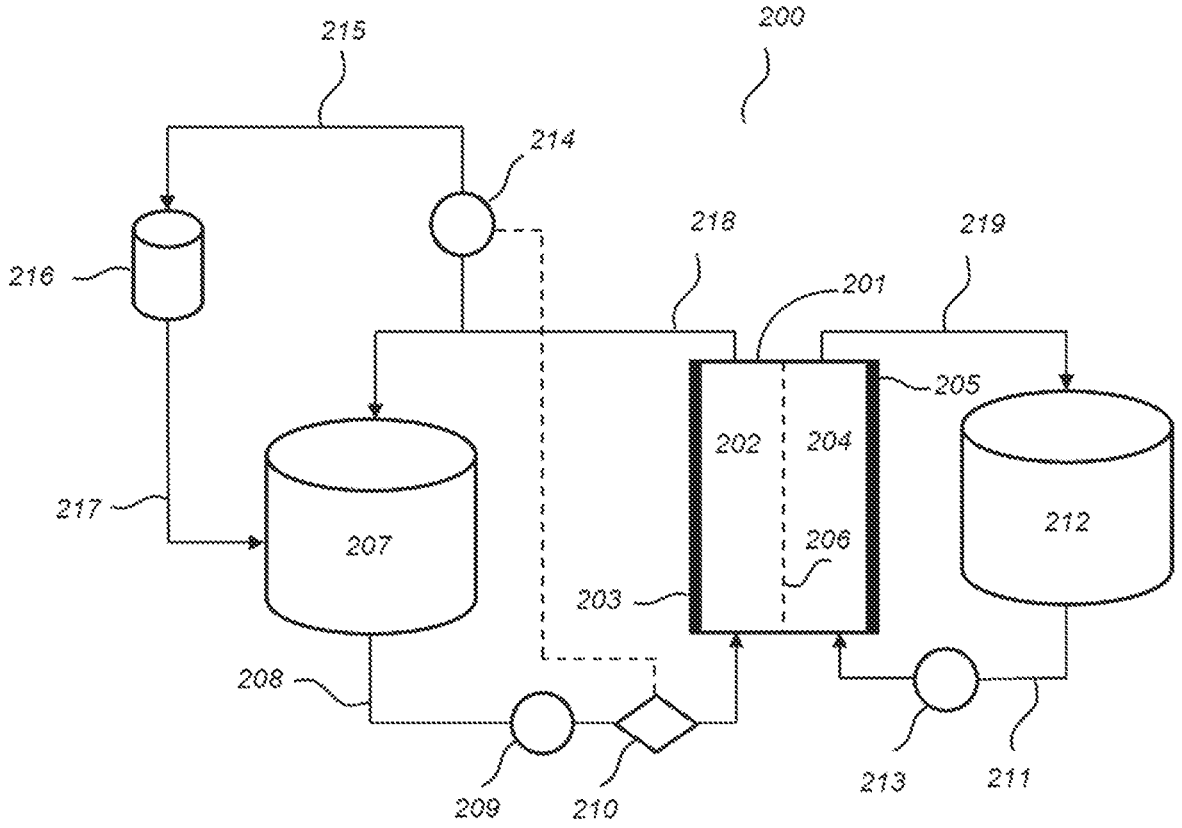

Referring to FIG. 2, a schematic illustrating a system 200 for the conversion of oxalic acid to glyoxylic acid according to another embodiment of the present disclosure is shown. System 200 may include an electrochemical cell 201 comprising a cathode compartment 202 comprising a cathode 203, and an anode compartment 204 comprising an anode 205, separated by an ion-exchange membrane 206. During operation, a liquid catholyte stream 208 comprising an aqueous oxalic acid solution is provided from a catholyte holding tank 207 by operation of a first pump 209 to cathode compartment 202. In cathode compartment 202, the oxalic acid containing catholyte is passed over cathode 203. By applying a suitable electric potential difference between the cathode 203 and the anode 205 using an external power source (not shown), glyoxylic acid is produced which is recoverable from the cathode compartment 202. An oxalic acid-depleted catholyte stream 218 is withdrawn from the cathode compartment 202 and returned to the catholyte holding tank 207. During operation, an acid-containing anolyte 211 is fed from an anolyte holding tank 212 to the anode compartment 204 by operation of a second pump 213. In anode compartment 204, the anolyte is passed over anode 205. The anolyte stream 219 leaving the anode compartment 204 is returned to anolyte holding tank 212.

During operation, the concentration of oxalic acid and glyoxylic acid may be monitored by a suitable apparatus 210 arranged for indirectly or directly measuring concentrations of constituents of catholyte stream 108, for example by means of conductivity or chromatography (such as HPLC). Apparatus 210 is connected to a third pump 214 which is configured for withdrawing an oxalic acid-depleted liquid catholyte stream portion 215 from catholyte loop stream 218 and providing it to solid oxalic acid vessel 216. In solid oxalic acid vessel 216, liquid catholyte stream 215 is contacted with solid oxalic acid to provide a concentrated oxalic acid solution 217 which may be provided to catholyte holding tank 207.

EXAMPLES

Example 1 (Comparative)

The electrochemical reduction of oxalic acid to glyoxylic acid was performed in a commercial flow cell, using a lead sheet as the cathode (electrode active area of 10 $cm^2$), an IrOx/Ti DSA mesh as the anode and a Nafion 324 membrane as the separator. The catholyte was a 0.6 M oxalic acid solution and the anolyte was a 1.0 M sulphuric acid ($H_2SO_4$) solution. Both electrolyte solutions were kept at a temperature of 15° C. and the recirculation flow rate was set at 160 ml/min. The electrolysis was performed at a current density of 100 $mA/cm^2$ for 24 hours until the oxalic acid concentration was lower than 0.3 M. The cell voltage varied from 3.8 to 4.6. No oxalic acid feed was added to the system. The oxalic acid and glyoxylic acid concentrations in the catholyte solution were continuously monitored by HPLC. A Faradaic efficiency in the range of 80-100% was obtained.

Figure 3:
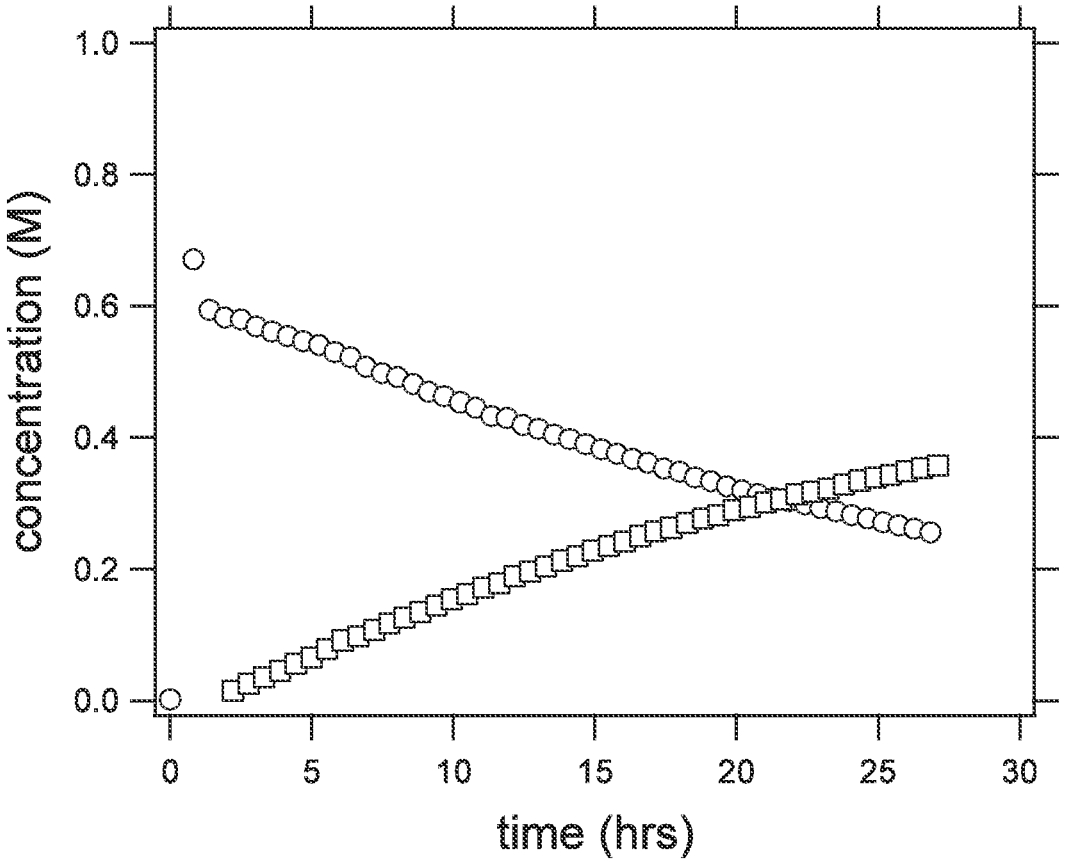
FIG. 3 shows the temporal evolution of the concentration of oxalic acid and glyoxylic acid in the catholyte during the electrochemical reduction of oxalic acid to glyoxylic acid, without make up of oxalic acid during the process.

The final catholyte solution contained 0.25 M of oxalic acid and 0.4 M of glyoxylic acid. FIG. 3 shows the temporal evolution of the concentration of oxalic acid (circles) and glyoxylic acid (squares) in the catholyte solution during the electrochemical reaction.

Example 2 (Comparative)

Figure 4:
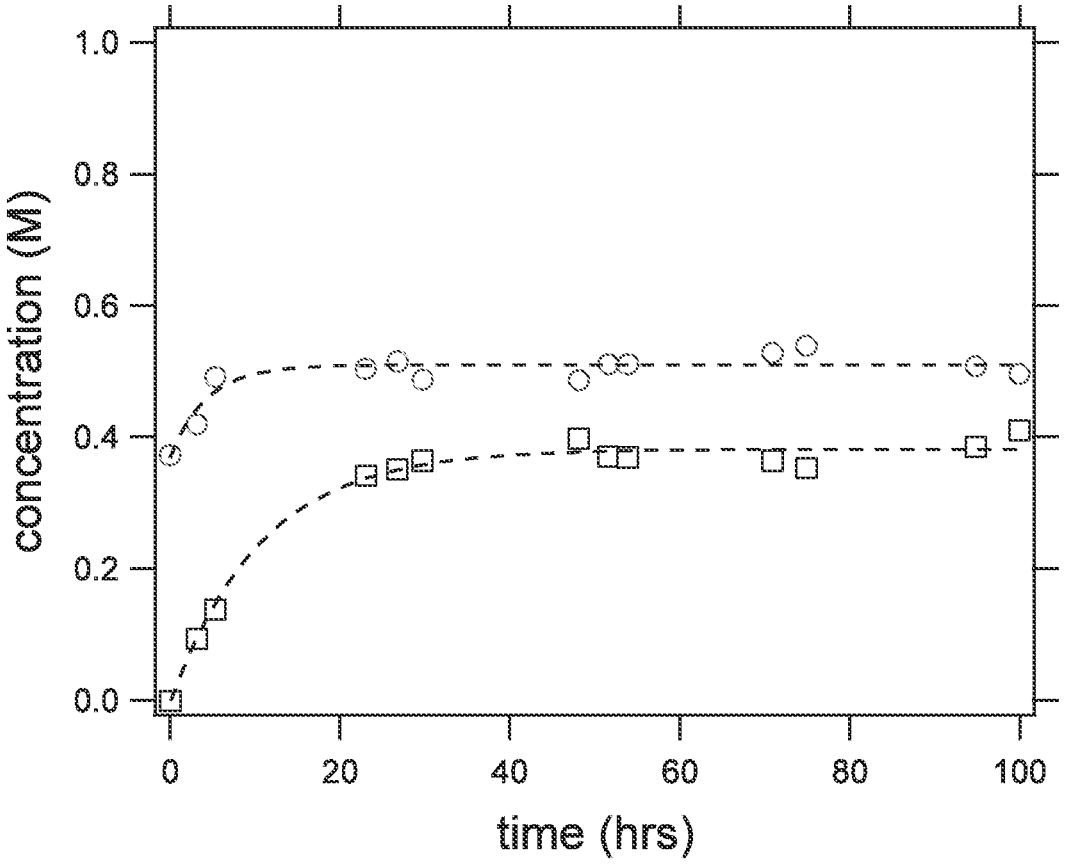
FIG. 4 shows the temporal evolution of the concentration of oxalic acid and glyoxylic acid in the catholyte during the electrochemical reduction of oxalic acid to glyoxylic acid with make-up of oxalic acid in the form of aqueous oxalic acid solution.

The electrochemical reduction of oxalic acid to glyoxylic acid was performed in a commercial flow cell, using a lead sheet as the cathode (electrode active area of 10 $cm^2$), an IrOx/Ti DSA mesh as the anode and a Nafion 324 membrane as the separator. The catholyte solution was a 0.4 M oxalic acid solution and the anolyte solution was a 1.0 M sulphuric acid ($H_2SO_4$) solution. Both electrolyte solutions were kept at a temperature of 15° C. and the recirculation flow rate was set at 160 ml/min. The electrolysis was performed at current density of 100 $mA/cm^2$ for 100 hours at constant volume. Oxalic acid was continuously supplied by adding an aqueous 1.0 M oxalic acid solution to the catholyte holding tank. The cell voltage was in the range of 4.2-4.3 V. The oxalic acid and glyoxylic acid concentrations in the catholyte solution were analysed by HPLC. A Faradaic efficiency in the range of 80 to 100% was obtained. The final catholyte solution contained 0.50 M of oxalic acid and 0.4 M of glyoxylic acid. FIG. 4 shows the temporal evolution of the concentration of oxalic acid (circles) and glyoxylic acid (squares) in the catholyte solution during the electrochemical reaction.

Example 3

Figure 5:
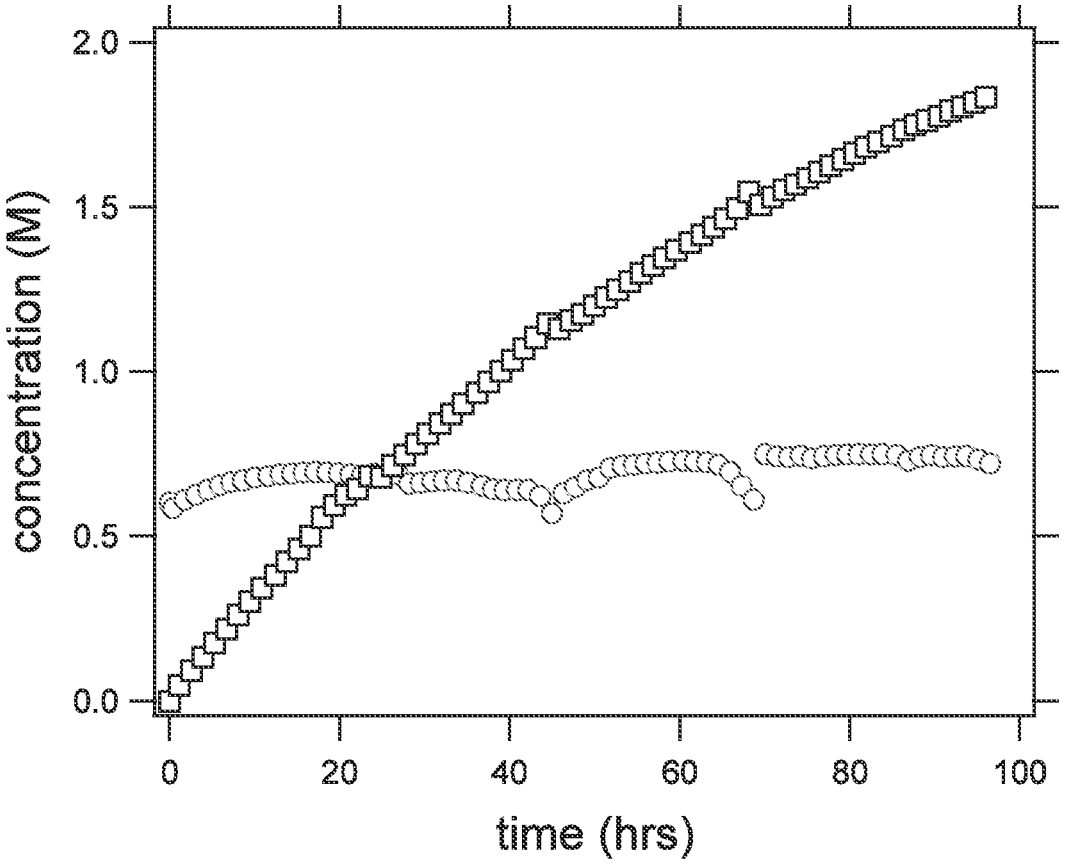
FIG. 5 shows the temporal evolution of the concentration of oxalic acid and glyoxylic acid in the catholyte during the electrochemical reduction of oxalic acid to glyoxylic acid with continuous make-up of oxalic acid using a side stream of the catholyte loop for dissolving solid oxalic acid.

The electrochemical reduction of oxalic acid to glyoxylic acid was performed in a commercial flow cell, using a lead sheet as the cathode (electrode active area of 10 $cm^2$), an IrOx/Ti DSA mesh as the anode and a Nafion 324 membrane as the separator. The catholyte solution was a 0.6 M oxalic acid solution and the anolyte solution was a 1.0 M sulphuric acid ($H_2SO_4$) solution. Both electrolyte solutions were kept at a temperature of 15° C. and the recirculation flow rate was set at 160 ml/min. The electrolysis was performed at current density of 100 $mA/cm^2$ for 100 hours. Oxalic acid was continuously supplied in concentrated form by having a side stream of the catholyte loop circulating through a column containing oxalic acid, at a flow rate of 1.5 ml/min. The oxalic acid concentration in the catholyte holding tank was kept constant in the range of 0.6-0.7 M. The cell voltage varied from 3.8 to 4.3 V. The oxalic acid and glyoxylic acid concentrations in the catholyte solution were continuously monitored by HPLC. A Faradaic efficiency in the range of 65 to 100% was obtained. The final catholyte solution contained 1.8 M of glyoxylic acid. FIG. 5 shows the temporal evolution of the concentration of oxalic acid (circles) and glyoxylic acid (squares) in the catholyte solution during the electrochemical reaction.

The invention claimed is:

1. A process for the electrochemical reduction of oxalic acid to glyoxylic acid, wherein the process is performed in an electrochemical cell comprising a cathode compartment containing a cathode, an anode compartment containing an anode, and an ion exchange membrane separating the anode compartment from the cathode compartment, wherein the process comprises the steps of:

(a) feeding an anolyte comprising an acid to the anode compartment;

(b) feeding a liquid catholyte comprising an aqueous oxalic acid solution to the cathode compartment, wherein the liquid catholyte is moving in a catholyte loop by being passed from a catholyte holding tank into the cathode compartment, over the surface of the cathode, being removed from the cathode compartment as an oxalic acid-depleted catholyte and returned to the catholyte holding tank;

(c) applying an electric potential difference between the cathode and the anode sufficient to produce a glyoxylic acid recoverable from the cathode compartment, wherein during the process one or more quantities of concentrated oxalic acid solution are provided to the liquid catholyte by the steps of:

(d) withdrawing a portion of the oxalic acid-depleted catholyte and contacting it with a quantity of solid oxalic acid to provide a concentrated oxalic acid solution; and (e) feeding at least a portion of the concentrated oxalic acid solution to the catholyte holding tank.

2. The process according to claim 1, wherein the oxalic acid-depleted catholyte is withdrawn from the catholyte holding tank.

3. The process according to claim 1, wherein the oxalic acid-depleted catholyte is withdrawn from the catholyte loop upstream of the catholyte holding tank.

4. The process according to claim 1, wherein the withdrawn portion of oxalic acid-depleted catholyte is contacted with the quantity of solid oxalic acid by feeding it through a column comprising solid oxalic acid to provide the concentrated oxalic acid solution.

5. The process according to claim 1, wherein the concentration of oxalic acid in the catholyte loop is determined intermittently or continuously.

6. The process according to claim 1, wherein the concentration of oxalic acid is determined in the catholyte loop upstream of the cathode compartment.

7. The process according to claim 1, wherein the one or more quantities of concentrated oxalic acid solution are provided to the liquid catholyte if the concentration of oxalic acid in the liquid catholyte fed to the cathode compartment fails below a predetermined level.

8. The process according to claim 1, wherein the concentration of oxalic acid in the catholyte holding tank is maintained in the range of 0.05 to 10 M.

9. The process according to claim 1, wherein the concentration ratio of glyoxylic acid to oxalic acid in the cathode compartment is maintained in the range of 0.2:1 to 12:1.

10. The process according to claim 1, wherein the concentration of oxalic acid in the liquid catholyte fed to the cathode compartment is measured continuously.

* * * * *